United States Patent [19]

Nigro

[11] 4,291,828

[45] Sep. 29, 1981

[54] COMBINATION COLLAPSABLE SELF-ERECTING SELF-LOCKING CARTON

[75] Inventor: Paul R. Nigro, Norridge, Ill.

[73] Assignee: Royal Continental Box Company, Cicero, Ill.

[21] Appl. No.: 139,835

[22] Filed: Apr. 14, 1980

[51] Int. Cl.[3] ..... B65D 5/36

[52] U.S. Cl. ..... 229/41 B; 229/39 R

[58] Field of Search ..... 229/41 B, 39 R

[56] References Cited

U.S. PATENT DOCUMENTS

| | | | |
|---|---|---|---|
| 2,011,232 | 8/1935 | Parks et al. | 229/41 B X |
| 2,017,724 | 10/1935 | Neumann | 229/41 B |
| 2,284,283 | 5/1942 | Himes | 229/41 B |
| 2,326,417 | 10/1943 | Ullrich | 229/41 B X |
| 2,388,190 | 10/1945 | Smart | 229/39 R |
| 2,676,750 | 4/1954 | Gastright | 229/39 R |
| 2,914,237 | 11/1959 | Malmad | 229/41 B |
| 3,455,498 | 7/1969 | Gadier | 229/41 B X |
| 3,494,536 | 2/1970 | Henry | 229/41 B X |

*Primary Examiner*—Davis T. Moorhead

*Attorney, Agent, or Firm*—Dressler, Goldsmith, Shore, Sutker & Milnamow, Ltd.

[57] ABSTRACT

A self-erecting, collapse-resistant, self-locking carton is formed from a single blank of material. The bottom of the box is formed by two inward folding bottom sections. Each bottom section is formed from two elements and includes a scored locking flap. Forcing the box from a flat folded condition to an upright condition interengages and latches the two bottom sections together. Folding, tearing or removing the locking flaps disables the self-locking collapse-resistant feature thereby permitting the box to be refolded to the flat condition.

20 Claims, 6 Drawing Figures

9
26
16
46
A
31
131
24
14
50
B
80
30
130
12
20
42
38
72
82
102
78
44
96
22
129
87
94
60
48
98
84
92
86
10
90
100
76
28
128
18
40
36
70
74

19
87'
82'
102'
46'
96'
50'
A'
84'
98'
94'
86'
92'
B'
100'
90'
80'
38'
72'
42'
78'
87'
82'
102'
44'
60'
48'
A'
84'
96'
86'
98'
94'
B'
92'
100'
90'
36'
76'
70'
74'
40'

FIG. 3
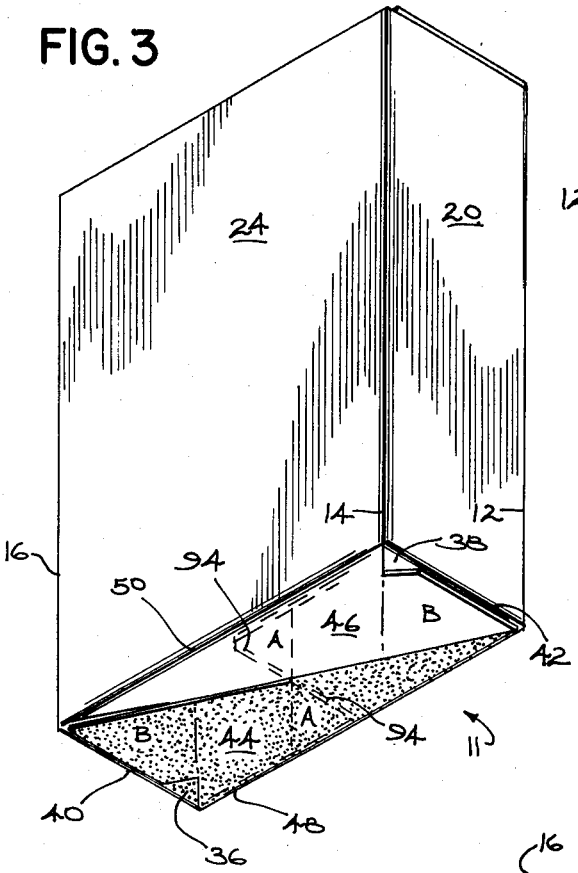
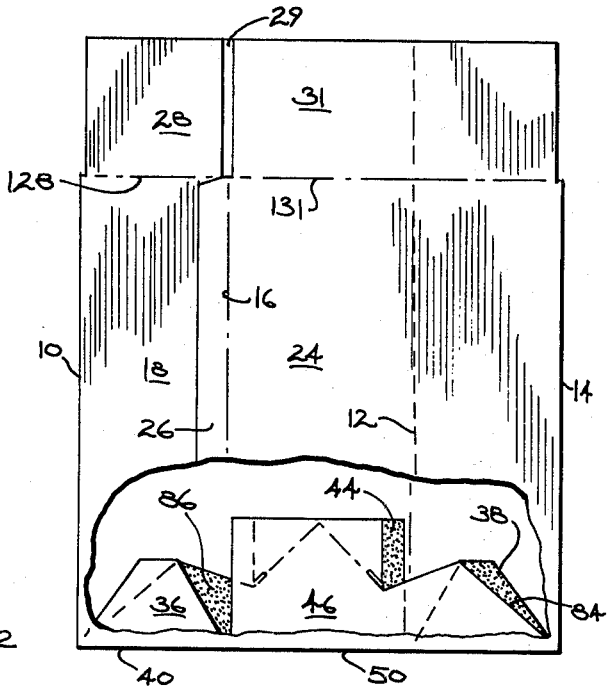
FIG. 4
FIG. 5
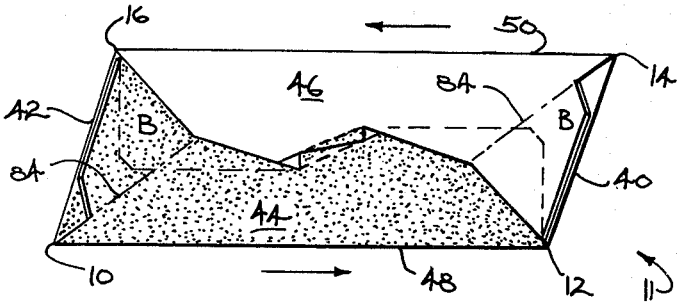
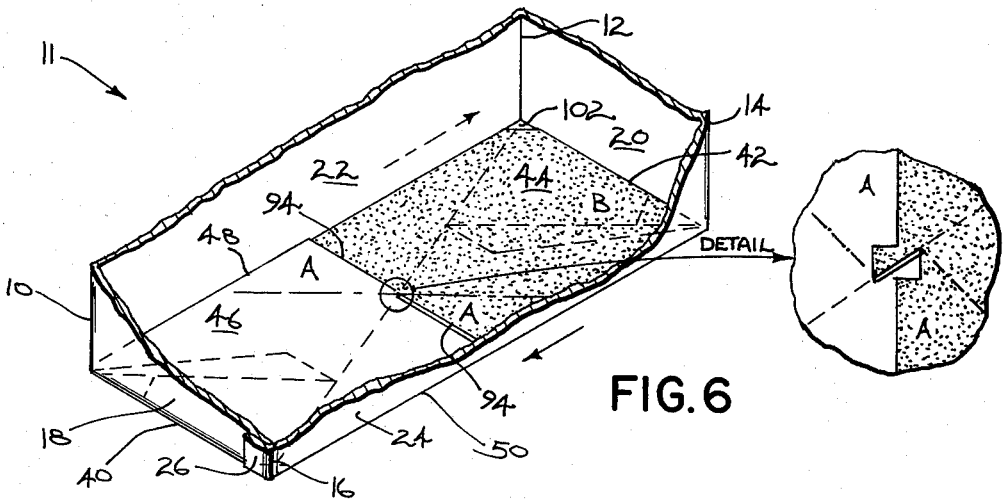
FIG. 6

COMBINATION COLLAPSABLE SELF-ERECTING SELF-LOCKING CARTON

TECHNICAL FIELD

This invention relates generally to self-erecting or automatic cartons, and more particularly concerns an automatic, self-locking carton that deploys in a self-supporting collapse-resistant configuration and incorporates construction features enabling the carton to be folded after use or modified to disable the self-locking feature without affecting the self-erecting capability.

BACKGROUND OF THE INVENTION

Automatic cartons, boxes, and containers are ones which can be quickly and easily set up or deployed in an erected condition without necessitating several operations of manually tucking in, cementing, or lockingly engaging various elements provided for those purposes. Automatic cartons having a self-locking feature are ones having a structure which is generally self-supporting after erection even when a relatively light grade of container stock is employed. In a collapsible carton, the carton can be readily folded and stored flat for subsequent use. A collapse-resistant carton is a self-locking carton which is substantially rigid after erection to the extent that parts of the carton have to be ripped, distorted, bent or folded to defeat the self-locking feature; such a carton truly resists collapse.

Because of space considerations, storage and/or dispensing requirements, containers are generally shipped and stored in a flat or folded condition rather than in an open or erect condition. When it is desired to use the container for receiving products to be shipped or dispensed, the folded container is manipulated by the user from its flat or collapsed condition to an open or unfolded condition after which the product may be placed in the opened container. For quick change from folded to open condition, simple manipulation is desirable which will automatically provide a closed bottom so that the product can be introduced and carried away by the user.

There are many operations in industry wherein a product is sent to one location for modification or repair and then returned to the originator or another user. In these cases, it is desirable to provide a carton or container which can be readily folded for temporary storage while the repair or modification is being performed. Later the folded carton can be removed from storage, opened, filled with the product, and sent back to the originator.

Similarly, there are operations in industry wherein the particular product to be packaged possesses sufficient rigidity such that the container itself need not be substantially self-supporting in its own right. In other words, where the product to be packaged is loose or of an amorphous form, the shipping container should be one having a substantially erect and self-supporting collapse-resistant construction; on the other hand, where the product is rigid and of a form generally resembling a box, a self-supporting structure may not necessarily required.

Finally, it is well known that many purchasers of goods save the shipping container after use. The container provides a convenient storage device. In addition, it is often used to protect the finish of products which are not used too often. As far as the end user is concerned, an automatic self-locking carton may not be desirable. By offering to customers, particularly consumers, a shipping container that can be readily collapsed and reused at a later time, the manufacturer can provide a value added feature to his product that builds good will at virtually no additional cost. A combination automatic, self-locking, self-supporting, collapse-resistant carton would then serve the needs of both the manufacturer and the customer. It would be a unique and valuable addition to the market place.

Various cartons having an automatic bottom closing feature have heretofore been provided; however, such cartons were single purpose designs featuring and interlocking construction emphasizing simple, easy, erection without any inherent strength. These prior designs were at most "self-locking"; by no means, could they be considered to be collapse resistant. Typical examples of such structures are: Smart U.S. Pat. No. 2,388,190; Gastright U.S. Pat. No. 2,676,750; and Ullrich U.S. Pat. No. 2,326,417—all of which disclose single purpose designs not suited to easy modification or reuse nor inherently collapse-resistant.

Thus, users of automatic cartons are forced into buying three kinds of cartons—those which are self-erecting and self-locking, those which are self-erecting and non-locking, and those which are self-erecting and collapse resistant. In other words, it would be desirable to have a box or carton that can be used for many uses at the option of the purchaser or end user. Accordingly, there has been a long-felt need to provide a corrugated carton construction which can be used for a variety of purposes.

SUMMARY OF THE INVENTION

Briefly, the subject carton is made from a single blank of material consisting of front and rear panels and a pair of side panels connected together along appropriate fold lines with the endmost panels being secured together by a glue flap to form a rectangular tube-like structure. The top of the box can be closed off using any conventional type of closure including the flip-top variety, if desired.

In addition, flaps are hinged to the bottom edges of each of the front, rear, and side panels to form the bottom of the box. A pair of bottom closure flaps is formed by joining together the sidewall flaps with one of the adjacent front or rear flaps. Each of the closure flaps is provided with a score line whereby the closure flap may be folded back to an overlying relation on the inside of the tubular enclosure defining the walls of the box. The closure flaps are sandwiched between the wall panels when the carton assumes a flat, collapsed condition. When the carton is set up from the collapsed condition, the closure flaps assume transversely disposed configurations with respect to the wall panels to form a closed carton bottom.

Each closure flap defines a scored locking flap and a center notch. When the box is deployed from a folded condition, the scored locking flap on each closure flap overlies the opposite closure flap to form a closed, substantially rigid collapse-resistant bottom structure. Each locking flap is generally in the form of a right triangle with one of the acute angled vertices at the approximate center of the bottom and with the two sides forming the right angle perpendicular to two walls associated with the closure flap. In addition, a notch is provided in each closure flap at the approximate center of the carton bottom. The notch and locking flaps cooperate together such that when the carton is deployed from an unfolded to a set-up condition, the notches in each closure flap assume an overlapping interlocking relationship which resists any tendency of the closure flaps to separate or fold inwardly from their overlying relationship. This holds the box in an erect, collapse-resistant, configuration.

The locking flaps are scored so as to be easily bent toward the interior of the carton during erection. In addition, the scoring enables the flaps to be readily removed by hand or with a tool. Once one or more of the locking flaps are removed, the relationship between the closure flaps and the notches is such that the bottom may be easily collapsed to return the carton to the flat-folded configuration.

Thus, the subject box is of simple construction being made of a single blank of material. Furthermore, it can be shipped and stored in a flattened condition so that it occupies a minimum amount of space. When needed, the box is easily set up simply by urging together the two opposite edges of the flattened tubular structure whereupon the bottom closure flaps automatically fold out and lock in place. If the box has to be refolded for storage, the collapse-resistant construction feature can be temporarily defeated by folding the locking flaps inwardly and carefully unlatching them from the opposing notches. Should the occasion arise where a container is needed not having the collapse-resistant feature, it is only necessary to rip, tear, or fold one or more of the locking flaps at the score line to provide a box that is both self-erecting and readily collapsible. Finally, in those applications where it is necessary to have a self-erecting, self-locking collapse-resistant box for one period of time (e.g. one shipment) and to have a self-erecting, collapsible box for another period of time (e.g. another portion of a shipment), it is only necessary to remove the locking flaps after the first use whereupon the box can be easily collapsed and folded away for storage. With all these advantages, the box shoudl prove to be a very successful and useful merchandising tool.

Numerous other advantages and features of the present invention will become readily apparent from the following detailed description of the invention and the embodiments thereof, from the claims and from the accompanying drawings in which each and every detail shown is fully and completely disclosed as part of this specification, and in which like numerals refer to like parts.

BRIEF DESCRIPTION OF THE DRAWINGS

FIG. 3 is a perspective view of the box formed from the blank shown in FIG. 1;

FIG. 4 is an elevational view of the box shown in FIG. 1 in a flat collapsed or knocked-down form with part of the box partially broken away to illustrate the relation of the bottom forming and automatic set-up closure flaps in that position;

FIG. 5 is a bottom plan exterior view illustrating the box shown in FIG. 4 in a partially erected condition and illustrating the manner in which the closure flaps interlock together; and FIG. 6 is a perspective view, with portions of the structure broken away, of the lower portion of the interior of the box shown in FIG. 1 in the erected condition illustrating the bottom closure arrangement which contains the essential features of the invention.

DETAILED DESCRIPTION

While this invention will be described in connection with the preferred embodiments, it will be understood that it is not intended to limit the invention to those specific embodiments. On the contrary, it is intended to cover all alternatives, modifications and equivalents as may be included within the spirit and scope of the invention as defined by the appended claims.

Figure 1:
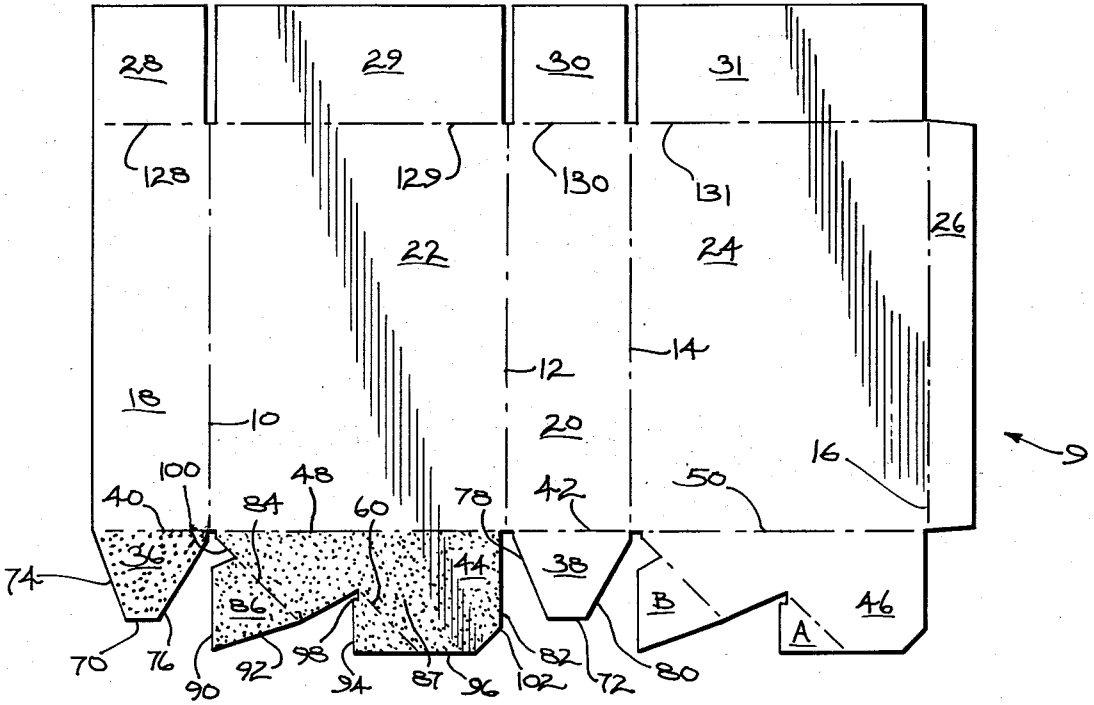
FIG. 1 shows a blank from which a generally rectangular box is formed.

The blank 9 from which the carton is formed may be produced from cardboard or the like of any suitable size and weight and is cut in the shape and form shown in FIG. 1. It is scored along various lines (shown by dashed lines on the Figures) to define the several walls and flaps of the carton. This scoring facilitates the bending of the blank 9 to produce the finished product.

The main portion of the blank or extended carton 9 is of generally rectangular shape and is provided with a plurality of transverse score lines designated by numerals 10, 12, 14, and 16, thus outlining the main portions of the carton. These main portions are a front wall 18, a rear wall 20 and two lateral walls 22 and 24. For convenience all of the walls, 18 through 24 inclusive, may be characterized as sidewalls or side wall means of the carton because they define the enclosure which is produced by the extended carton 9.

At one edge of side wall 24 there is formed a narrow flap 26, which serves as an agency by which one edge of the side wall 24, which is at one end of the blank 9, is secured to one edge of the front wall 18 which is at the opposite end of the blank 9. In completing the carton, the flap 26 is bent on score line 16 and is caused to contact the innerface of front wall 18, and secured thereto by means of glue, paste, staples, fasteners or the like. Thus, a rectangular tubular enclosure 11 is formed which is capable of being opened to the position shown in FIG. 3, which may also be collapsed in a substantially flat condition as shown in FIG. 4.

It should be noted that the faces of the walls shown in FIG. 1 form the interior of the container shown in FIGS. 3, 4, 5 and 6. In the flat or folded position the front wall 18 and lateral wall 24 are in one plane which is substantially parallel to and in contact with rear wall 20 and the other lateral wall 22 which are likewise in the same plane. The two sets of walls being connected by hinge connections provided at the bending points of the carton along score lines 12 and 16.

Referring to FIG. 1, the blank 9 is extended at one side to form a conventional top cover flap 28 connected to the front wall 18 along a score line 128. Other top cover flaps 29, 30, and 31 are similarly defined by score lines 129, 130 and 131 respectively.

It is apparent from the drawings that bottom flaps 36 and 38 are of a generally trapezoidal configuration, having their outer edges 70 and 72 parallel with the respective score lines 40 and 42 which define and connect these bottom flaps 36 and 38 with the front and rear walls 18 and 20 of the carton. Each bottom flap 36 and 38 also has two inclined lateral edges—74 and 76 for bottom flap 36 and edges 78 and 80 for bottom flap 38.

On the lower edges of the front wall 18 and the rear wall 20 are coacting cover flaps 36 and 38 defined respectively by score lines 40 and 42 and adapted to coact with two similar bottom wall elements or flaps 44 and 46 formed respectively on the lower parts of the side walls 22 and 24 and defined respectively by score lines 48 and 50. Bottom wall elements 44 and 46 are generally rectangular in shape having a length about equal to the length of the lateral walls 22 and 24 and a width about equal to the width of the front or rear walls 18 and 20.

The bottom elements 44 and 46 constitute the main portions of the bottom wall. The bottom wall is formed in two sections or closure flaps, one made up of bottom flaps or elements 36 and 44 and the other made up of bottom flaps or elements 38 and 46. Each of the main bottom elements 44 and 46 includes at one end a relatively long, straight edge 82 extending outwardly from the main part of the blank 9 at substantially right angles to one end score lines 48 and 50. A score line 84 extends diagonally at about a forty-five degree angle from the main part of the blank 9. This score line 84 extends from the opposite end of the score lines 48 and 50 which separate the main bottom elements 44 and 46 from the main part of the blank 9. The forty-five degree diagonal score line 84 divides the main bottom elements 44 and 46 into two triangular-shaped areas 86 and two essentially trapezoidal-shaped areas 87.

Each of these triangular areas 86 has two edges 90 and 92. Trapezoidal areas 87 is defined by free edges 82 and 96 and the extension of score line 84. Edge 96 is parallel to the main score lines 48 and 50. Edges 92 and 94 are inclined towards each other so as to form a generally V-shaped cutout; edge 92 is generally parallel to a diagonal of the bottom element 44 and 46. The extreme free edge 96 of the trapezoidal portions 87 of the main bottom elements 44 and 46 has a length generally equal to about one-half of the width of the corresponding lateral walls 22 and 24. At the common intersection of edges 92 and 94, a center L-shaped notch 98 is formed. A generally V-shaped notch 100 is cut along the inside end of edge 90 (i.e., at the intersection between edge 90 and score line 48 or score line 50). A short inclined edge 102 is formed at the intersection of edges 82 and 96. Finally, a score line 60 extends from the center notch 98 to the extreme free edge 96 of the main bottom elements 44 and 46. This score line 60 is inclined at an angle of about forty-five degrees relative to edge 96. The function and purpose of the notches 98, 100 and score lines 60, 84 will be explained at a later point in this discussion.

In summary, bottom elements 44 and 46 are defined by edges 82, 102, 96, 94, 92, 90 notches 98 and 100, and two diagonal score lines 60 and 84. Diagonal score line 84 defines a generally triangular-shaped tab or flap 86 bound by edges 90 and 92. For convenience, this flap 86 is labeled "B" in the drawing. Finally, score line 60 defines another triangular-shaped tab or flap "A" bound by edges 94 and 96.

Figure 2:
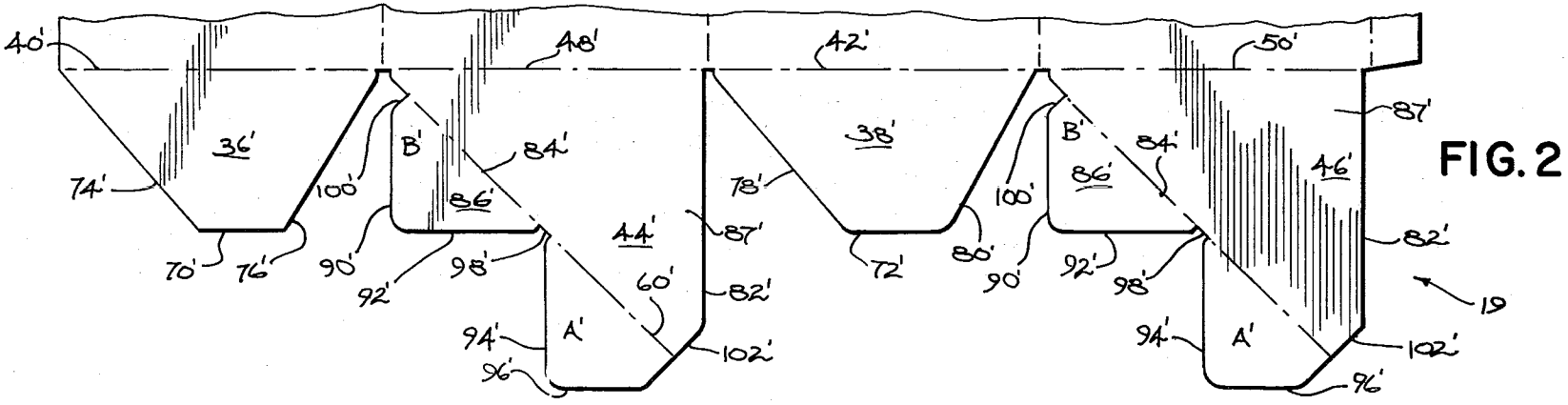
FIG. 2 is a partial plan view of an embodiment showing the bottom portion of a blank from which a substantially square box is formed.

FIG. 2 illustrates the bottom portion of a blank 19 for a box having a generally square base. All of the features and edges appearing in FIG. 1 appear in FIG. 2. The same reference numbers have been used with the addition of a "prime" after the reference number. The only edge changing its relative orientation is the edge identified as 92'. In FIG. 2, edge 92' is defined by a line passing through the notch 98' of the bottom wall and extending parallel to the folding line 48' or 50' defining the main bottom elements 44' and 46'.

In the case of a square box, there is sufficient overlap between the smaller bottom elements 36' and 38' and the main bottom elements 44' and 46' for gluing or stapling. However, with a rectangular box (FIG. 1), the smaller bottom elements 36 and 38 would not adequately overlap the main bottom elements 44 and 46 if edge 92 were cut perpendicular to its intersecting edge 90. To provide greater overlap, a substantially rectangular box has the edge 92 beginning at the center notch 98 and extending along a major diagonal of the bottom wall. Substantially square boxes have this edge 92' defined by a line beginning at the center notch 98' and running parallel to the folding line 48' or 50' defining the associated main bottom element 44' or 46'. Because of the function they serve, the flaps identified as "A" in the drawings are called "locking flaps" and those flaps labeled "B" are called "glue flaps."

In assembling the carton 11 the smaller bottom wall elements 36 and 38 are secured respectively to the glue flaps "B" on the adjacent main bottom elements 44 and 46 causing them to overlap to a certain extent by pasting, gluing, or stapling the glue flaps "B" to the overlapping parts of the adjacent sidewall flaps 36 and 38. In this manner there are produced two similar bottom wall sections, each of which has an essentially rectangular portion and trapezoidal portion. The rectangular portion is defined by edges 82, 96, and the extension of edge 94. The trapezoidal portion is defined by edge 92 generally superimposed over edge 74 and edge 76 generally superimposed over score line 40 or 42 and the extension of edge 94. These two bottom sections are creased upwardly or inwardly on score lines 84 so that each of the bottom sections may be folded within the folded carton in between the two sidewalls of the carton to which it is hingedly connected, by bending or creasing on the score lines 40 and 48 in one instance and score lines 50 and 42 in the other instance. The V-shaped notch 100 on each bottom section facilitates folding of the bottom sections inside the carton 11. By removing material at the corner between the two bottom elements 36,, 44 or 38, and 46 the tendency of the walls to resist folding is reduced.

The position of the bottom sections when the carton is folded can be ascertained from FIG. 4 which shows the carton in a collapsed or folded condition with a portion of the sidewalls 18, 24 removed to illustrate the internal folding of the two bottom sections. Specifically, as illustrated in FIG. 4, the bottom section defined by flap elements 46 and 38 overlies the bottom section defined by flap elements 44 and 36.

In this condition the cartons are flat or collapsed and thus occupy very little space until such time as they are required for use. The folded carton is capable of being opened or extended merely by the exertion of pressure on its two opposite edges which, as will be observed from FIG. 5, are designated by numerals 14 and 10, and coincide with the score lines of the blank shown in FIG. 1. This pressure on opposite edges 10, 14 of the folded carton 11 is sufficient to move it to a fully erect or set-up condition without the manipulation or handling of any of the individual bottom flaps or wall elements. Specifically, the pressure used to erect the carton 11 acts to interlock the two bottom sections together for the purpose of holding the carton in the set-up or erect configuration shown in FIGS. 5 and 6.

FIG. 5 illustrates the relationship of the bottom sections when pressure is applied to erect the carton 11. Direction of movement of the two side-walls 48 and 50 is shown by the arrows on the figure. For ease of understanding one of the bottom sections has been shaded to illustrate the interlocking relationship between the two bottom sections. Specifically, as pressure is applied, the sidewalls 40, 50, 42 and 48 of the carton 11 move into position at generally right angles to each other to form a rectangular tubular enclosure. As the sidewalls assume these positions, the two bottom sections will move towards a horizontal plane (assuming that the carton is in the upright position). This movement of the bottom sections occurs because of the hinged connection of each bottom section to the bottom edges of the two associated sidewalls and because of the score line or crease 84 between the two elements forming each bottom section.

As the folded carton 9 approaches its ultimate set-up position 11, the diagonal edges 92 (94' in the case of a generally square box) of the two bottom sections approach each other and finally the locking flaps "A" thereof engage each other. As pressure is continued they bend inwardly along their defining score line 60 towards the interior of the carton. This "bending-on-engagement" feature allows the two bottom sections to slide past one another so that engagement is made with the L-shaped notches 98 at the center of each bottom section. This affects an interlocking arrangement between the two bottom sections. In other words, the notch 98 and locking flap "A" of one bottom section engages the notch 98 and locking flap "A" of the other bottom section. This is clearly indicated in FIG. 5. Once the two bottom sections deploy the residual rigidity of the material forming the locking flaps "A" will restore the locking flaps to position substantially in the same plane as the two bottom sections. This "latches" the two locking flaps together effectively precluding collapse without bending, tearing or folding one or more of the locking flaps and unlatching the two notches.

Throughout this engagement process the V-shaped notches 100 at the fold point of each bottom section facilitates erection without a binding effect being produced at the corner seam between the two elements forming that bottom section. Similarly, the clipped edges 102 facilitate the bottom sections assuming a flat condition when the box 11 is fully erected. Binding at the corners is reduced.

Referring to FIG. 6 it will be noted that when the bottom sections are engaged and interlocked certain portions of the two sections are in an overlapping condition. Specifically, when viewed from the interior of the box 11 the rectangular portion of each bottom section overlaps the trapezoidal portion of the opposite bottom section. It will be noted by inspection of the drawings that the two trapezoidal portions abut one another along the projection of edge 94 (See FIG. 3) and that the two rectangular portions abut each other along the same edge projection 94 (See FIG. 6). Thus, the two rectangular portions form the inside of the bottom of the box and the two trapezoidal portions form the outside of the bottom of the box.

The carton 11 in the fully extended or setup position is ready to be filled or used. When filled, the upper end of the box may be sealed by forcing together the top flaps 28, 29, 30 and 31. Should pressure be applied to any two opposite corners of the box 11 so as to force it to a collapsed or folded condition, it will be noted that locking flaps "A" are forced to move in the direction of the L-shaped notches 98 at the center of the opposite bottom section (see detail of center of FIG. 6). In other words, as long as the locking flaps "A" are in an overlying relationship with respect to notch 98 of the opposite bottom section the box 11 cannot be collapsed. With this design the box is inherently collapse resistant. Any external force applied to drive the bottom sections inwardly is repulsed by the buckling strength of the latched locking flaps. In addition, the bending-onengagement feature of the locking flaps "A" allows the area of the main bottom elements 44, 46 to be generally greater than if the locking flaps were substantially rigid and unscored. Greater area improves the inherent strength of the box. This feature also allows the carton to be erected with less applied force and deformation of the bottom wall elements.

However, should it be desired to collapse the box when it is in the set-up condition all that needs to be done is to fold, bend or remove one or more of the locking flaps "A" along the score line 60 defining the locking flap "A". When this is done, the effect is to remove the locking flaps from interlocking engagement with the notches. Moreover, the folding of a single locking flap "A" removes the interlocking relationship between the two bottom sections. Significantly, if any one of the locking flaps "A" is removed, the box 11 may be folded to the flat or collapsed condition without affecting the ability of the box to form a bottom when force is applied on two opposite edges 14, 10 to form the box 11. In other words the removal of the locking flaps "A" does not affect the automatic set-up capability of the carton.

Should a customer or a user of the box wish to fold the box 11 for storage after it has been filled or used, he needs only to tear, fold inwardly or remove one or more of the locking flaps "A". When it is desired to use the box again, the user needs only to apply force to opposite edges to erect the box in the set-up condition. If one of the locking flaps has been folded rather than removed, refolding that locking flap "A" to the flat condition restores the locking feature and prevents the box 11 from collapsing prematurely. Filling the box holds the refolded locking flap flat.

Thus, it will be seen that the container just described functions both as an automatic, self-erecting, self-locking carton collapse-resistant and an automatic self-erecting foldable carton. The automatic set-up and locking feature is simple and relatively unfailing in operation. The interlocking relationship of the locking flaps opposes any tendency for the box to collapse even with the direct application of an inward collapse face. Nonetheless, the box 11 itself is capable of being quickly folded or converted to an automatic non-locking or collapsible box.

From the foregoing disclosure, it should be evident that the novel carton just described may be assembled in a minimum time thereby substantially reducing the cost of assembly and storage. The bottom wall-forming sections that are within the open carton and which sustain and support the weight of the contents are integrally and permanently united with the walls of the carton along the various hinge lines. The tabs or flaps that form the bottom wall of the carton have portions interlocking each other that are integrally united and hinged to opposite sidewalls with the locking flap of one of the bottom sections overlapping the opposite bottom section. Furthermore, each of the bottom sections incorporates a scored locking flap that, in one instance, insures that the two sections lock together to form a substantially rigid collapse-resistant carton and, upon its removal or disablement, insures that the carton can be readily and quickly folded away for storage.

The above detailed description has been given for ease of understanding only. No unnecessary limitations are to be understood therefrom, as modifications will be obvious to those skilled in the art. It is, of course, intended to cover by the appended claims, all such modifications as fall within the scope of the claims.

I claim:

1. A folding carton formed from a blank of cardboard, comprising:

(a) four sidewalls hingedly connected by their edges to form a generally rectangular tubular enclosure;

(b) bottom wall means formed by two similarly-shaped bottom sections, each section being formed from two elements fixedly joined together and hingedly connected to the lower edges of two adjacent sidewalls, each of said sections being scored along a line permitting folding thereof to correspond with the folding of the associated sidewalls, pressure on opposite corners of the folded carton forcing the sidewalls to open outwardly with the bottom sections gradually assuming a position generally transverse to said sidewalls; and (c) scored flap means joined to said bottom sections for interengaging and latching together said bottom sections, said scored flap means deploying with said bottom sections to overleaf and hold said bottom sections in said substantially transverse position, said scored flap means bending inwardly towards the interior of said carton while said bottom sections deploy outwardly from the interior of said carton thereby freeing said bottom sections to overleaf one another, deployment of said bottom sections freeing scored flap means to return to a position generally transverse to said sidewalls whereby said bottom sections are locked in place to form a substantially rigid, collapse-resistant structure, said bottom wall means remaining locked in a deployed position until said scored flap means are folded inwardly towards said sidewalls thereby freeing said bottom wall means to be collapsed inwardly to fold said carton for storage, said bottom sections capable of being redeployed to said transverse position to reform said bottom wall means in response to pressure applied to the opposite corners of said folded carton.

2. The folding carton defined in claim 1, wherein:

said scored flap means is formed on each of said similarly-shaped bottom sections and is defined by a flap projecting from an oblique score line joining the center of said bottom wall means with the free outer edge of said bottom section and a notch adjoining said oblique score line at the center of said bottom wall means, at least one of said flaps being selectively removable from one of said bottom sections.

3. The folding carton defined in claim 1, wherein:

one of said two elements forming said two bottom sections is defined by a broken diagonal line;

said line commencing at a point between the two elements forming said bottom section and extending along a line generally perpendicular to the score line of the associated sidewall defining said one of said two elements;

thence proceeding on a line inwardly towards the center of said bottom wall;

thence proceeding on a line generally perpendicular to the score line of the associated sidewall defining said one of said two elements and outwardly and away from said center and said associated sidewall to a first point, the distance of said first point from said associated sidewall being substantially equal to the width of the adjacent sidewall;

thence along a line generally parallel to the score line of the associated sidewall to a second point, the distance of said second point from said first point being substantially equal to one-half the width of said associated sidewall; and thence to said score line defining said one of two elements forming said two bottom sections.

4. The folding carton defined in claim 3, wherein:

said one of said two elements forming said two bottom sections includes a first score line extending at an acute angle outwardly from the point of commencement of said broken diagonal line to the free edge of said element, said score line defining a first triangular shaped flap;

said first triangular flap and said adjacent element forming one of said two bottom sections being fixedly attached to each other whereby when said carton is opened said two elements forming said bottom sections deploy to form said bottom wall means.

5. The folding carton defined in claim 4, wherein:

said scored flap means is defined by a second score line generally parallel to said first score line and extending outwardly from the center of said bottom section to the free edge of said element, said second score line defining a second triangular shaped flap;

said second triangular shaped flap being free to bend inwardly from the plane of said bottom section towards the score line of the associated sidewall defining said one of said two elements;

whereby when said carton is opened with said bottom wall means deployed said second triangular-shaped flap overlies the opposite bottom section.

6. The folding carton defined in claim 5, wherein:

the center of said bottom section adjacent to said second triangular-shaped flap includes a notch, one edge of said notch being contiguous to one edge of said second triangular-shaped flap, the base of said notch lying along said second score line whereby once said second triangular-shaped flaps assume an overlying relationship, said second flaps are interlocked together preventing said carton from assuming a collapsed condition, said second triangular-shaped flaps and said notches defining said scored flap means.

7. The folding carton defined in claim 3, further including:

a generally V-shaped notch at the point of commencement of said broken diagonal line with one leg of said V-shaped notch lying along said first score line, said V-shaped notch facilitating the folding and unfolding of the two elements of said bottom section along said first score line.

8. The folding carton defined in claim 7, wherein:

one of said second score lines defining said second triangular-shaped flaps is sufficiently deep and repetitious to facilitate ripping said second triangular flap free of the associated bottom section whereby said carton may be collapsed to a folded configuration suitable for storage.

9. The folding carton defined in claim 3, wherein:

the two edges of said bottom section at said second point are truncated so as to define a line segment inclined at an acute angle to each of said two edges, said segment facilitating said bottom sections assuming said generally transverse position with the erection of said container.

10. An automatic set-up corrugated carton formed from a precut paper blank, said carton locking into position upon being set up, comprising:

(a) four interconnected side panels folded into a generally rectangular configuration with a first score line extending between each adjacent side panel;

(b) four bottom panels each interconnected with one of said side panels and forming a bottom for said carton, said four bottom panels extending in a plane generally perpendicular to said side panels when said carton is set up, with a second score line extending between each bottom panel and its respective side panel;

(c) a glue flap formed on one end of two non adjacent bottom panels for fixedly joining these bottom panels to an adjacent bottom panel to form two paired bottom panels, said paired bottom panels having an over and under relationship wherein each glue flap extends over the opposite end of the adjacent paired bottom panel with one end of said paired bottom panels falling under the opposite end of the other paired bottom panels and the opposite end falling under said one end of the other of said two paired bottom panels, a third score line extending from the intersection between each glue flap and its adjacent bottom panel, whereby the carton is adapted to be opened into a set-up condition and closed to a collapsed condition;

(d) at least one scored locking flap on one of the bottom panels forming one of said two paired bottom panels; and (e) a second locking flap on one of the bottom panels forming the other of said two paired bottom panels, said second locking flap engaging and pressing against said scored locking flap;

whereby opening said carton from a folded condition forces said second locking flap to press against said scored locking flap, said locking flaps opposing said opening and holding said corrugated carton in an open configuration until sufficient pressure is manually applied to bend said scored locking flap towards the interior of said carton, said locking flaps cooperating with each other after said carton is opened to lock said carton in an open collapse-resistant configuration.

11. The automatic set-up corrugated carton defined in claim 10, wherein:

one of said two paired bottom panels includes two notches;

a first notch generally V-shaped in configuration and lying to the interior of the score line defining said glue flap; and a second notch generally L-shaped in configuration with one upright of said L-shaped notch contiguous to an edge defining said fixed and said scored locking flaps and with the base of said L-shaped notch lying along the center of said bottom panel, said first notches facilitating the folding of said carton to a collapsed condition, said second notches cooperating with each other to lock said carton in a substantially rigid collapse-resistant set-up condition whereby said carton cannot be collapsed without severing, bending, or folding at least one of said locking flaps.

12. The automatic set-up corrugated carton defined in claim 10, wherein:

said third score line is generally inclined at an angle of forty-five degrees relative to said second score line.

13. The automatic set-up corrugated carton defined in claim 10, wherein:

said scored locking flap opposing said collapse is defined by a score line joining the center of said bottom panel having said glue flap, said score line extending outwardly at a generally acute angle to the outer free edge of said bottom panel.

14. The automatic set-up corrugated carton defined in claim 13, wherein:

at least one of said locking flaps is selectively removable from its said bottom panel to permit said carton to collapse from the set up configuration to a folded configuration by the manual application of pressure.

15. In a corrugated container of the type having a bottom which automatically deploys to a set-up configuration upon opening said container from a flat folded condition to a set up condition, said container being formed from a blank having four side panels and four bottom panels, said four bottom panels depending downwardly from said side panels:

two of said four bottom panels facing oppositely to each other having a glue flap fixedly joined to a bottom panel adjacent thereto;

said glue flap being defined by a first score line extending from the intersection between the two side panels associated with said two adjacent bottom panels to the edge of the bottom panel having said flap;

said two adjacent bottom panels when joined together having an over and under relationship wherein said glue flap lies above said adjacent bottom panel;

said bottom panels joined together by said glue flaps forming two paired bottom panels;

said paired bottom panels having an over and under relationship with respect to each other when said container is opened from a folded to a set up condition wherein one end of one of said paired bottom panels lies under the opposite end of the other of said two paired bottom panels thereby automatically deploying said carton in a set-up configuration; and locking means joined to said bottom panels having said glue flap, for locking said bottom panels in a substantially rigid collapse-resistant set-up condition.

16. The corrugated container defined in claim 15, wherein:

said locking means is defined by flaps each formed by a second score line along the bottom panels having said glue flap;

said second score lines extending diagonally from the center of the bottom panel towards the free margin of the bottom panel, to facilitate said flaps in bending inwardly towards the interior of said container to permit erection of said container.

17. The corrugated container defined in claim 16, wherein:

each of said second score lines is inclined at an angle of about forty-five degrees and extends outwardly and away from the direction of said glue flap.

18. The corrugated carton defined in claim 16, wherein:

said bottom panel includes two notches;

a first notch of a generally V-shaped configuration with one leg of said V-shaped notch lying along the score line defining said glue flap; and a second notch of a generally L-shaped configuration with one upright of said L-shaped notch contiguous to an edge defining said locking flap, said V-shaped first notch facilitating the folding of said carton to a collapsed condition and said L-shaped second notch cooperating with the opposite bottom panel to hold said carton in said se' up condition.

19. The corrugated container defined in claim 15, wherein:

said locking means includes at least one scored flap located on one of said bottom panels having said glue flap for engaging and pressing against an adjacent bottom panel during folding and unfolding of said container;

said scored flap opposing the folding and unfolding of said container whereby said container is opened by manual application of sufficient pressure to overcome the force of said scored flap by bending said scored flap inwardly towards the interior of said container, said container remaining thereafter in said open collapse-resistant position without tending to collapse due to the force of said scored flap opposing the inward collapse of bottom panels;

the bending or tearing of said scored flap towards the interior of said carton and away from the opposite bottom panel freeing said paired bottom panels to fold along said first score line whereby said container may be forced to resume a flat folded condition.

20. The corrugated carton defined in claim 19, further including:

a generally L-shaped notch on one of said bottom panels with one upright of said L-shaped notch contiguous to an edge defining said scored flap, said L-shaped notch cooperating with the opposite bottom panel to hold said carton in a set-up condition.

* * * * *